US007609045B2

(12) United States Patent
Wang

(10) Patent No.: US 7,609,045 B2
(45) Date of Patent: Oct. 27, 2009

(54) REFERENCE VOLTAGE GENERATOR PROVIDING A TEMPERATURE-COMPENSATED OUTPUT VOLTAGE

(75) Inventor: Zhenhua Wang, Zurich (CH)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 11/721,159

(22) PCT Filed: Dec. 1, 2005

(86) PCT No.: PCT/IB2005/053996

§ 371 (c)(1),
(2), (4) Date: Oct. 24, 2008

(87) PCT Pub. No.: WO2006/061742

PCT Pub. Date: Jun. 15, 2006

(65) Prior Publication Data

US 2009/0039861 A1 Feb. 12, 2009

(30) Foreign Application Priority Data

Dec. 7, 2004 (EP) ..... 04300854

(51) Int. Cl.
*G05F 3/16* (2006.01)

(52) U.S. Cl. ..... 323/314; 323/907; 327/513; 327/541

(58) Field of Classification Search ..... 323/312–316, 323/907; 327/513, 538–543
See application file for complete search history.

(56) References Cited

U.S. PATENT DOCUMENTS

| | | | | |
|---|---|---|---|---|
| 6,160,393 | A | 12/2000 | Ahn et al. | |
| 6,437,550 | B2 * | 8/2002 | Andoh et al. | 323/315 |
| 6,466,081 | B1 * | 10/2002 | Eker | 327/541 |
| 6,566,850 | B2 | 5/2003 | Heinrich | |
| 6,680,643 | B2 | 1/2004 | Conte et al. | |
| 6,919,753 | B2 * | 7/2005 | Wang et al. | 327/513 |
| 7,205,755 | B2 * | 4/2007 | Ito et al. | 323/316 |

* cited by examiner

*Primary Examiner*—Jessica Han
(74) *Attorney, Agent, or Firm*—Robert Iannucci; Seed IP Law Group PLLC

(57) ABSTRACT

The present invention concerns a reference voltage generator (40) that provides a reference voltage (Vref new). The voltage generator (30) is operated at a supply voltage (Vdd) being lower than the Silicon bandgap voltage. It comprises a MOSFET transistor (MN; MN3; MP4; MP7) serving as transconductor (Gptat). An input node for feeding a drain current ($I_{ptat}$) into the drain of said MOSFET transistor (MN; MN3; MP4; MP7) is provided and an output node is connected to the drain and gate of said MOSFET transistor (MN; MN3; MP4; MP7). A current generator (42) allows the MOSFET transistor (MN; MN3; MP4; MP7) to be operated in a specific mode where the drain current ($I_{ptat}$) has a positive temperature coefficient ($\alpha_{ptat}$) and the transconductor (Gptat) has a negative temperature coefficient ($\alpha_{ptat}$). The dimensions (W, L) of the MOSFET transistor are chosen such that said negative temperature coefficient ($\alpha$GM) approximates said positive temperature coefficient ($\alpha_{ptat}$) such that said reference voltage (Vref new), as provided at said output node, is temperature-compensated.

7 Claims, 6 Drawing Sheets

REFERENCE VOLTAGE GENERATOR PROVIDING A TEMPERATURE-COMPENSATED OUTPUT VOLTAGE

FIELD OF THE INVENTION

The present invention concerns voltage generator providing a stable output voltage.

BACKGROUND OF THE INVENTION

Many CMOS and BiCMOS ICs comprise a large digital core and some analog peripheral functions. These analog functions typically include reference circuits used, among other things, for the analog block, for supply voltage regulation, and for certain of the digital circuits (e.g., for power-on-reset circuits). The most widely used implementation of voltage reference circuits with a low temperature coefficient is the so-called bandgap-reference circuit.

Outputting a reference voltage close to the bandgap of the silicon of 1.205V, bandgap circuits have long been a standard for realization using either bipolar or CMOS transistors. Today, however, it is very difficult, or even impossible, to design a reference circuit that outputs bandgap voltage in most advanced CMOS technologies because for proper operation, the supply voltage Vdd of the bandgap circuit has to be higher than the bandgap voltage Vbg, usually 1.3-1.5V. On the other hand, the supply voltage of CMOS circuits has been continuously falling from 3.3V for 0.35 μm process, 2.5V for 0.25 μm, 1.8V to 0.18 μm, and 1V for today's 90 nm technology, respectively, as illustrated in FIG. 1. It is seen in this Figure that roughly from 0.13 μm CMOS technology onwards, the supply voltage Vdd becomes too low for any reference circuit to output the bandgap voltage Vbg=1.205V.

In general, the output voltage of most of the known CMOS and non-CMOS bandgap reference circuits is the sum of a diode voltage and the voltage across a resistor. Typically, the current that flows through the resistor is proportional to the absolute temperature in a way to compensate, in the first order, the negative temperature coefficient of the forward voltage of the diode.

This current can be generated in several manners. In a typical CMOS bandgap voltage reference circuit the current is generated in such a way that it is linearly dependent from the temperature and usually the thermic voltage Ut is used. If a bandgap voltage with higher accuracy over temperature is required, quite a complex curvature compensation has to be used. Furthermore, as mentioned above, this kind of bandgap reference circuit cannot be employed at supply voltages below the semiconductor material bandgap voltage.

In U.S. Pat. No. 6,566,850 B2, a low-voltage bandgap reference circuit is proposed. A current is simply mirrored into a transistor and flows to an output resistor. This circuit thus provides an output voltage which is not very stable over temperature. The shown circuit cannot be operated at very low voltages. It is another disadvantage of the circuit proposed in this US patent that a depletion type transistor is required. Adding such a depletion type transistor to a standard process entails additional costs.

U.S. Pat. No. 6,160,393 concerns a voltage reference circuit where a PTAT current is forced to flow through a combination of a pMOS transistor and an nMOS transistor in series or in parallel. The shown circuit cannot be operated at very low voltages. Furthermore, the temperature performance of the circuit is not addressed at all. The-temperature stability appears to be worse than the stability of a conventional bandgap. It is a further disadvantage of the circuit proposed in U.S. Pat. No. 6,160,393 that is requires a simultaneous ion implantation for the nMOS and pMOS transistors. This, however, is not available for standard CMOS processes.

Yet another circuit is presented in U.S. Pat. No. 6,680,643 B2. This circuit requires many different elements, such as a PTAT circuit, an operational transimpedance amplifier, a differential operational amplifier, an amplifier current extraction circuit and an output stage. It is obvious that this leads to a very complex realization. This complexity adds to the costs, make the development time longer, degrades the reliability and consumes more power. Furthermore, the supply voltage has to be at least 1.5 V.

There is, therefore, a strong demand for a new principle for generating the reference voltage in today's and future CMOS technologies where the reduced supply voltage does not pose any constraint to hamper the realization of a reference voltage. At such a low supply voltage Vdd, it is clear that the generated reference voltage has to be lower than the bandgap voltage in value.

Furthermore, it would be generally desirable to provide a solution allowing a reference voltage to be generated with equal or even better performance in temperature stability.

It is thus an object of the present invention to provide a reference voltage generator that can be employed even in situations where the supply voltage Vdd is lower than the bandgap voltage.

It is a further objective of the present invention to provide a reference voltage generator that providing a reference voltage that is less temperature dependent than the reference voltage provided by conventional bandgap reference circuits.

It is a further objective of the present invention to provide a reference voltage with very high accuracy and low-voltage.

SUMMARY OF THE INVENTION

These disadvantages of known systems, as described above, are reduced or removed with the invention as described and claimed herein.

An apparatus in accordance with the present invention is claimed in claim 1. Various advantageous embodiments are claimed in claims 2 through 6.

According to the present invention, a reference voltage generator is proposed that provides the desired reference voltage. The voltage generator is operated at a supply voltage being lower than the bandgap voltage in value. A MOSFET transistor is employed serving as transconductance. A current is fed into the drain of the MOSFET transistor. This current is provided by a current generator that allows the MOSFET transistor to be operated in a specific mode where the current has a positive temperature coefficient and the transconductance has a negative temperature coefficient. The MOSFET transistor's dimensions are chosen such that the negative temperature coefficient approximates the positive temperature coefficient. Due to this, the reference voltage, as provided by said reference voltage generator, is temperature-compensated.

A reference voltage generator according to the present invention has the advantage that a stable reference voltage generation is possible even in most advanced CMOS technology where it is no more possible to design a reference circuit that outputs a bandgap voltage. That is, the reference voltage sources presented herein can run at any supply voltages.

It is a further advantage that the reference voltage generator is much simpler than standard bandgap reference circuits. Furthermore it consumes less power and it is easier to design.

Reference voltage sources, according to the present invention, occupy only a fraction of the silicon area that a conventional bandgap voltage requires. A high accuracy of the reference voltage can be achieved.

Additional features and advantages of the invention will be set forth in the description that follows, and in part will be apparent from the description.

BRIEF DESCRIPTION OF THE DRAWINGS

For a more complete description of the present invention and for further objects and advantages thereof, reference is made to the following description, taken in conjunction with the accompanying drawings, in which.

DESCRIPTION OF PREFERRED EMBODIMENTS

Figure 2:
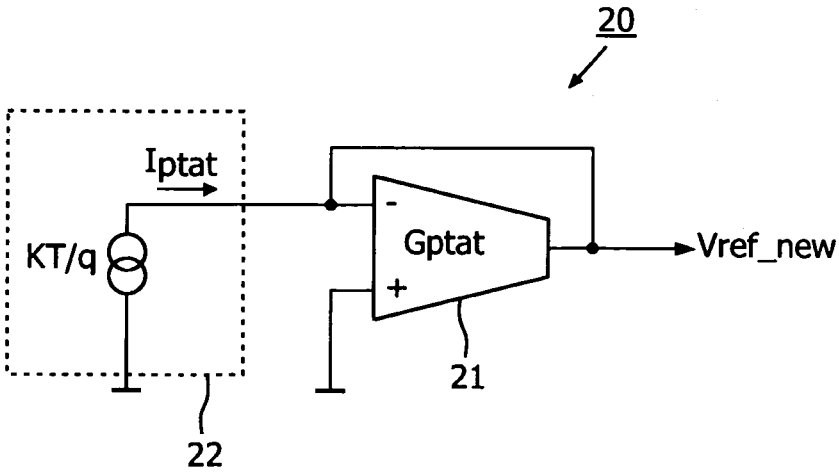
FIG. 2 shows a schematic block diagram of a reference voltage generator of the present invention.

The working principle of the present invention is described in connection with FIGS. 2 and 3. The new principle that is explored here to generate the reference voltage at a supply voltage Vdd that is too low to output a bandgap voltage is shown in FIG. 2. The key element is a so-called transconductance 21 (Gptat) being proportional to the absolute temperature T. With a constant input voltage, this transconductance 21 would output a current proportional to the absolute temperature T. According to the present invention, however, the transconductance 21 is operated in a reverse mode (special mode).

The transconductance 21 generates a voltage output while its input is a current proportional to the absolute temperature T. This current Iptat may be generated by a current generator 22 based on the thermal voltage KT/q, similar to the familiar bandgap reference circuits, for instance, as illustrated in FIG. 2. The thermic voltage Ut=KT/q has a temperature coefficient TC of +0.085 mV/° C. at room temperature. If the temperature coefficient TC of the transconductance 21 exactly matches the temperature coefficient TC of the thermal voltage, i.e., if the transconductance 21 has exactly the same TC, a stable reference voltage Vref_new can be obtained at the output node 23, provided that one has a negative sign.

In the following the temperature effects to MOS transistors will be addressed since these kind of transistors are strongly temperature dependent. Two main parameters responsible for this temperature dependency are the effective mobility and the threshold voltage. The former shows a temperature dependency in a power of −(1.5-2.0), while the latter exhibits an almost straight-line decrease with the temperature. It can be expected that in the saturation region, the temperature effect of these parameters will be drain-current dependent. At high currents, the decrease of the mobility with temperature wins out, while at lower temperature the decrease of threshold voltage will prevail.

Throughout this patent specification, data of a standard 0.25 μm CMOS technology are used for presentation. Typical process parameters of this technology are a gate oxide thickness W=5 nm, a minimum gate length L=0.25 μm, and the threshold voltages of p-type MOS and n-type MOS transistors are 0.53V and 0.57V, respectively. The supply voltage Vdd is 0.8V if not otherwise specified.

Figure 3:
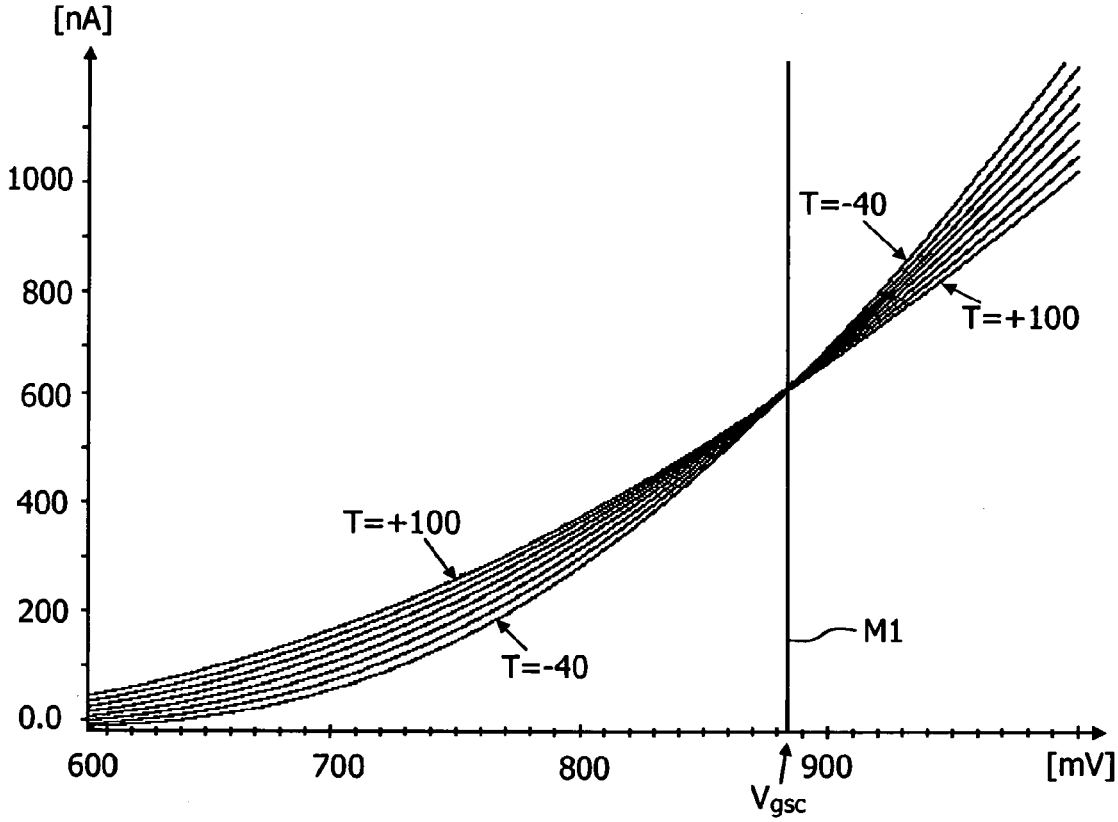
FIG. 3 shows how the drain current (Ids) versus the gate-to-source voltage (Vgs) of a MOSFET transistor for temperature variations from −40 degrees to +100 degrees in 20 degrees steps.

At various temperatures, the drain current of an n-type MOS transistor versus its gate-to-source voltage, Vgs, is shown in FIG. 3. From this Figure it can be derived that at certain gate-to-source voltage Vgsc, which is roughly 886 mV in the present example and marked by a vertical line M1, the drain current becomes practically temperature independent over the entire temperature range. This particular gate-to-source voltage Vgsc is hereinafter referred to a predetermined voltage. It is important to notice that below the predetermined voltage Vgsc the drain current increases with the temperature, and this increase is getting slower as Vgs approaches Vgsc, meaning that the TC is positive, and decreases as Vgs increases and approaches Vgsc. For Vgs>Vgsc, the TC becomes negative. This region is not relevant to this invention.

Simulations revealed that the location of the predetermined voltage Vgsc roughly does not alter when the transistor's size changes. The only difference is the drain current, which increases with W/L. The present invention builds on these findings.

Figure 4:
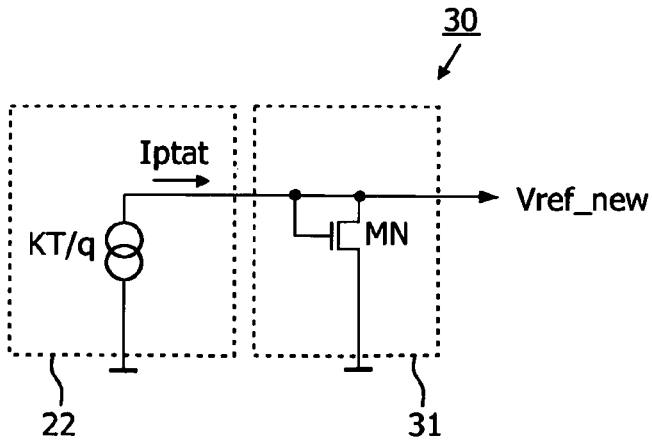
FIG. 4 shows a schematic block diagram of a first embodiment of the present invention.

One can write the drain current Iptat in FIG. 2 as expressed in equation (1):

$$I_{ptat}=I_{ptat}(tr)[1+\alpha_{ptat}(t-tr)] \tag{1}$$

where $\alpha_{ptat}$ is the temperature coefficient of the current Iptat, and tr is the room temperature. Generally, transconductors have roughly the same complexity as operational amplifiers. In order to operate at very low supply voltage and consume very low power, it is desired that the transconductor 21 be as simple as possible. If it could be made even with a single MOS transistor, one can be sure this would be absolutely the simplest transconductor one can ever make. The characteristics shown in FIG. 3 suggests this is indeed possible. For Vgs<Vgsc, the transconductance 21 of a MOS transistor Gm can be written as expressed in equation (2):

$$G_m=G_m(tr)[1+\alpha_{GM}(t-tr)] \tag{2}$$

where $\alpha_{GM}$ is the temperature coefficient of the transconductance Gptat, if $$\alpha_{ptat}=\alpha_{GM} \tag{3}$$

and if $$Gm(tr)\cdot \mathrm{Vref_new}=I_{ptat}(tr), \tag{4}$$

then this Gm is exactly the transconductance one seeks for, and the inventive reference principle can be realized as simple as that shown in FIG. 4.

FIG. 4 shows a schematic block diagram of a first embodiment of a reference voltage generator 30, according to the present invention. As illustrated in FIG. 4, a current Iptat is fed into an n-type MOSFET transistor MN serving as transconductor 31. This current Iptat is provided by a current generator 22 allowing said MOSFET transistor MN to be operated in a specific mode where the current Iptat has a positive temperature coefficient $\alpha_{ptat}$ and $\alpha_{GM}$ the transconductor Gptat has a negative temperature coefficient $\alpha_{GM}$. The gate and drain of the MOSFET transistor MN are both connected to the current source 22. The source of the transistor MN is connected to ground and the output voltage Vref_new is provided between the drain and source of the transistor MN. The reference voltage generator 30 can operate at a supply voltage lower than 1.2V. The dimensions W/L of the MOSFET transistor MN are chosen such that the negative temperature coefficient $\alpha_{GM}$ approximates the positive temperature coefficient $\alpha_{ptat}$ such that the reference voltage Vref_new, as provided between by the diode-connected MN, is temperature-compensated.

Figure 5A:
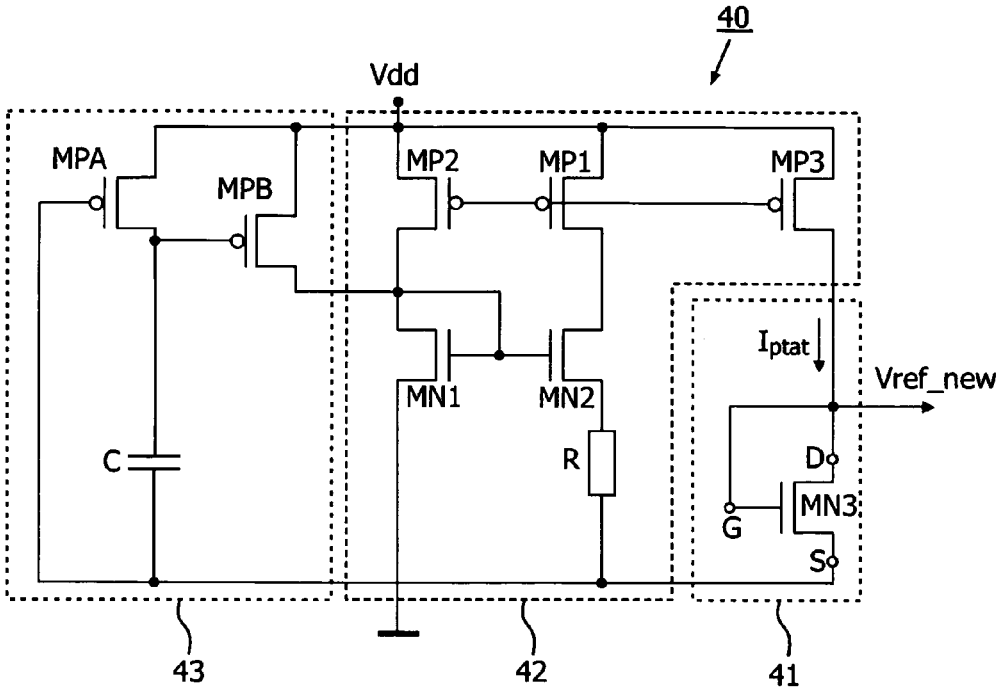
FIG. 5A shows a schematic block diagram of a second embodiment of the present invention.

A detailed reference voltage generator 40, according to the present invention, is given in FIG. 5A. The reference voltage generator 40 incorporates an optional start-up circuit 43. The purpose of this start-up circuit 43 is to guarantee a reliable start-up upon power on.

A current generator 42 is employed. This current generator 42 provides a drain current Iptat, as indicated in FIG. 5A. The current generator 42 comprises a first n-type MOSFET transistor pair MN1 and MN2, a second p-type MOSFET transistor pair MP1 and MP2, a resistor R. and a p-type transistor MP3. The transistors MN1, MN2, MP1, MP2 and the resistor R are responsible for generating the current Iptat. This current Iptat is mirrored (or scaled) by the transistor MP3 and delivered to the transconductor 41. The transistors MN 1 and MN2 are designed to operate in the weak inversion. The transistor MN2 has a wider channel width W than the transistor MN1, but both transistors have the same channel length L. The transistors MP1, MP2, and MP3 operate in the saturation region, and the transistor MP3, as mentioned above, delivers the required Iptat current. This Iptat current flows into the drain D of the MOSFET transistor MN3. The gate G and the drain D of the MOSFET transistor MN3 are both connected to the current source 42. The source S of the transistor MN3 is connected to ground and the output voltage Vref_new is provided between the drain D and source S of the transistor MN3. The reference voltage generator 40 is capable of operating at a supply voltage lower than 1.2V. The dimensions W/L of the MOSFET transistor MN3 are chosen such that the negative temperature coefficient $\alpha_{GM}$ approximates the positive temperature coefficient $\alpha_{ptat}$ such that the reference voltage Vref_new, as provided between the drain and source, is temperature-compensated.

The Iptat current that is required to ensure proper operation of the reference voltage generator 40 can be expressed as follows:

$$I_{ptat} = C\frac{kT}{qR}\cdot\ln(AB) \tag{5}$$

where A, B and C are the aspect ratios of the transistors MN2 to MN1, MP2 to MP1, and MP3 to MP1, respectively. Normally, MP1 and MP2 are matched pairs so B=1.

Figure 6:
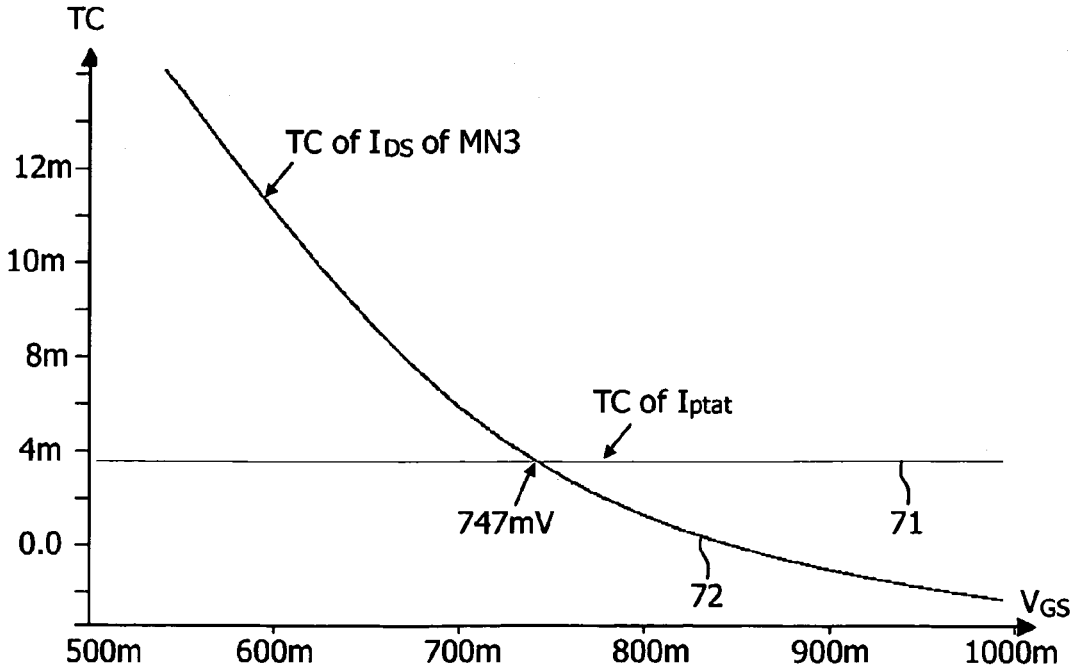
FIG. 6 shows a temperature coefficient of a transconductor, cf FIGS. 4 (M) and 5A (MN3), versus the gate-to-source voltage (Vgs) at room temperature.

FIG. 3 shows that transistor MN3 can have either a positive or a negative TC. The fact that its positive TC indeed covers that of the Iptat current, is demonstrated in FIG. 6. The horizontal axis 71 is the gate-to-source voltage Vgs applied to the transistor MN3. Because Vgs does not affect $\alpha_{ptat}$, the TC of the drain current Iptat is a constant of 0.387%/° C., which includes the effects of the temperature dependency of the resistor R. The resistor type may be RPZ (high resistance poly), with TC1=−1454 ppm/° C. and TC2=6.35 ppm/° C. At room temperature tr, the TC of the transistor MN3, $\alpha_{GM}$, is also shown in the FIG. 6 (cf. curve 72 in FIG. 6). For a variation of the voltage Vgs from 0.5V to 1V, the $\alpha_{GM}$ drops monotonously from about 0.22%/° C. to −0.1%/° C. The line 71 and the curve 72 intercept at about Vgs=0.747V, as illustrated in FIG. 6, which should be the expected output voltage Vref_new of the reference voltage generator 40.

Figures 7A, 7B:
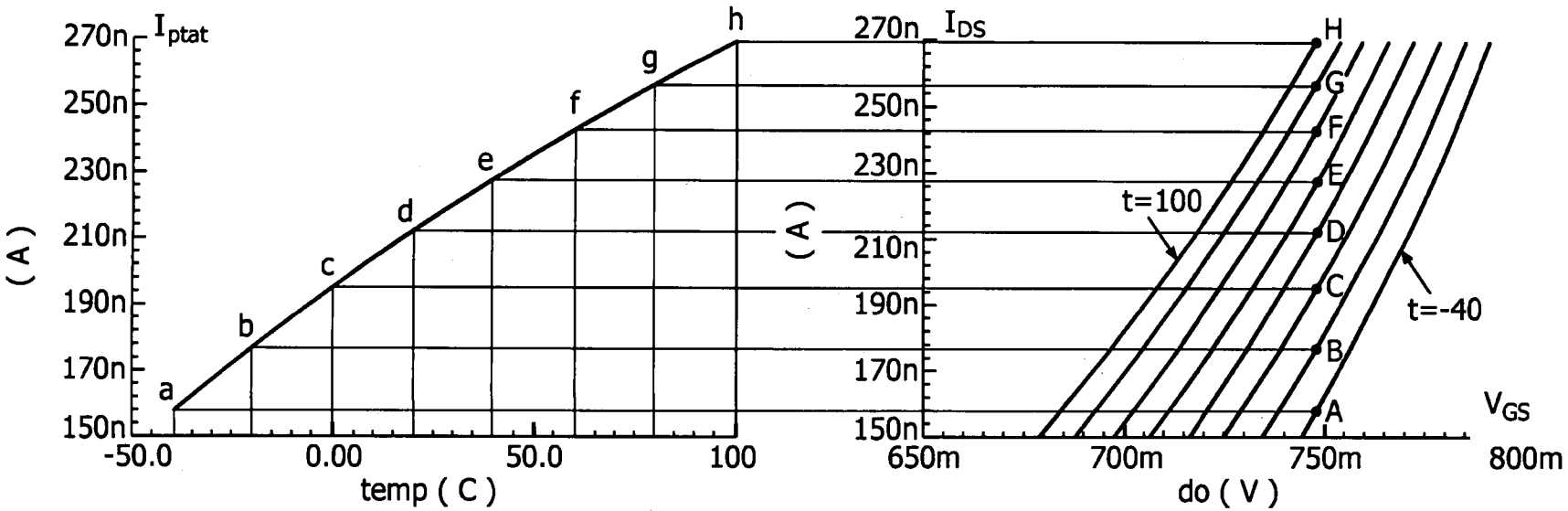
FIGS. 7A through 7C shows three diagrams that can be used to design a reference voltage generator, according to the present invention.

In the following section a graphical method is presented that can be used to design reference voltage generators, according to the present invention. The graphical method is used in order to be able to determine the voltage Vref_new in FIG. 5A. Using this method, the temperature dependency of the voltage Vref_new can very easily and conveniently be determined, and, if so desired, compared with the existing bandgap circuits. For doing so, in a first step one displays the drain current of the transconductor MP3, Iptat, at some interested temperatures. In the present embodiment, Iptat is determined at the following temperatures: t=−40, −20, 0, 20, 40, 60, 80, and 100 degrees (C.). These results are shown in FIG. 7A, at locations marked by labels, a, b, c, d, e, f, g, and h, respectively. The curve from a through h represents the drain current Iptat versus the temperature t. In a next step, the drain current Iptat of MN3 versus the gate-to-source voltage Vgs of MN3 is measured at the same temperatures, and the complete results are plotted in FIG. 7C. This plot in FIG. 7C is similar to the one in FIG. 3.

Figure 7C:
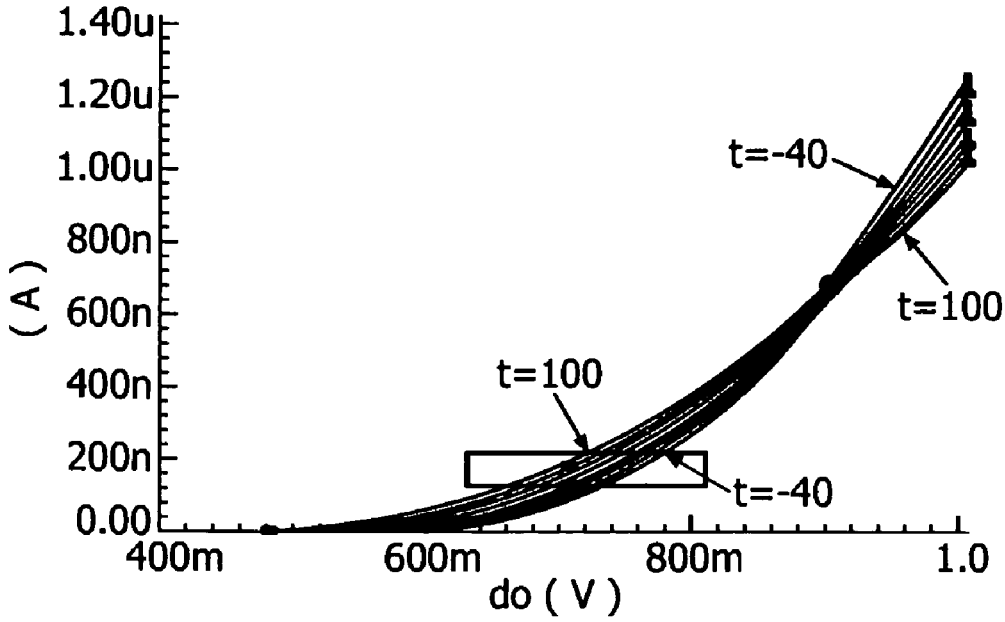

In order to determine the output voltage Vref_new graphically, one just puts a portion of these results as given in FIG. 7C, in FIG. 7B, next to the Iptat curve of FIG. 7A. This is done in such a way that the current Iptat in FIG. 7B has the identical vertical scale as Iptat in FIG. 7A. Then one draws a horizontal straight line starting from point a in FIG. 7A to FIG. 7B to intercept the Ids curve obtained at t=−40. The intercept point is marked by label A. Similarly, another horizontal straight line can be drawn from point b, to intercept the curve obtained at −20, and mark the intercept point by label B. In a similar manner, one draws horizontal straight lines from point c, d, e, f, g, and h in FIG. 7A to intercept, respectively, with Ids curves obtained at t=0, 20, 40, 60, 80, and 100, in FIG. 7B. Then one marks these intercept points respectively by C, D, E, F, G, and H. The projecting of these intercept points at the x-axis (Vgs axis) of FIG. 7B give the output voltage Vref_new at these temperatures. Connecting these intercept points A through H one after another results in an almost vertical straight line in FIG. 7B, meaning an almost temperature-independent output voltage Vref_new is obtained.

Figure 7D:
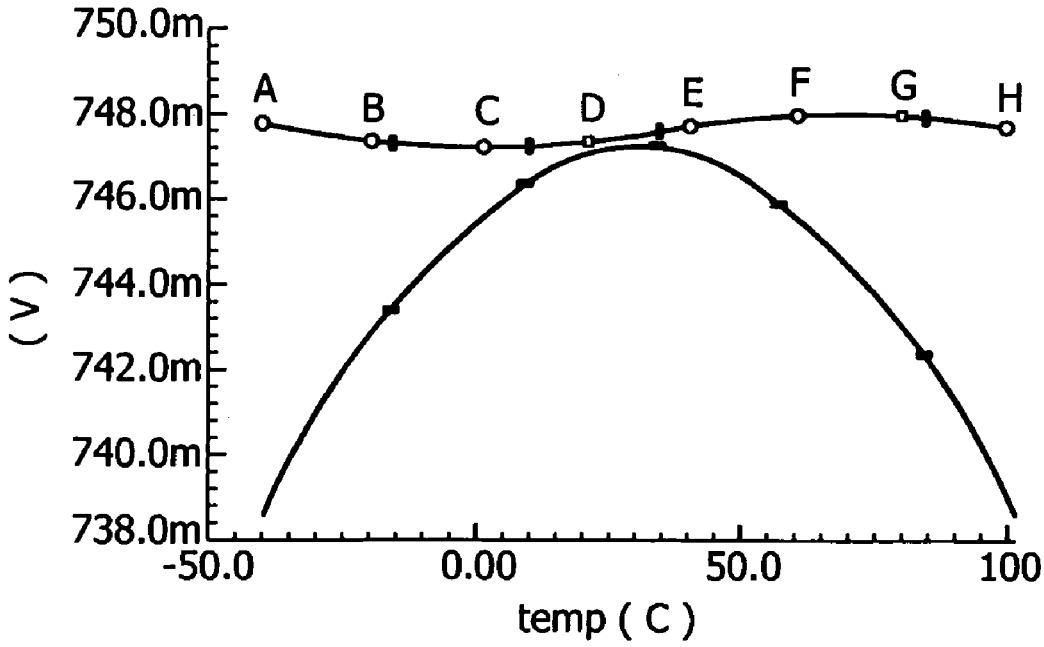
FIG. 7D shows a comparison between the results obtained with the present invention and those obtained with a conventional bandgap circuit, scaled to the same voltage.

Alternatively, the projected value at the x-axis in FIG. 7B can be redrawn in another graph, e.g., FIG. 7D now with the temperature as x-axis. It is seen that the generated voltage Vref_new is virtually independent of the temperature. The voltage Vref_new, as represented in FIG. 7D, is obtained by taking measures at various temperatures in including those temperatures mentioned above. Indeed, the calculated TC is as low as 7.6 ppm/° C. For comparison purposes, FIG. 7D also shows the temperature dependency of a standard bandgap design at a supply voltage Vdd of 1.8V. The output voltage Vref_bg was scaled from bandgap voltage down to the same output voltage in order to be able to compare the two voltages. This gives a TC of 81.3 ppm/° C. By comparison, the reference voltage Vref_new generated by a reference voltage generator according to the present invention is more than 10 times better than the standard bandgap voltage Vref_bg. The effect of the resistor's TC was also studied. The results are similar or even better with other types of resistors with positive TCs, or with ideal resistor with TC=0.

The above results have been confirmed by means of a simulation verification of the reference voltage generator proposed and claimed herein.

Figure 1:
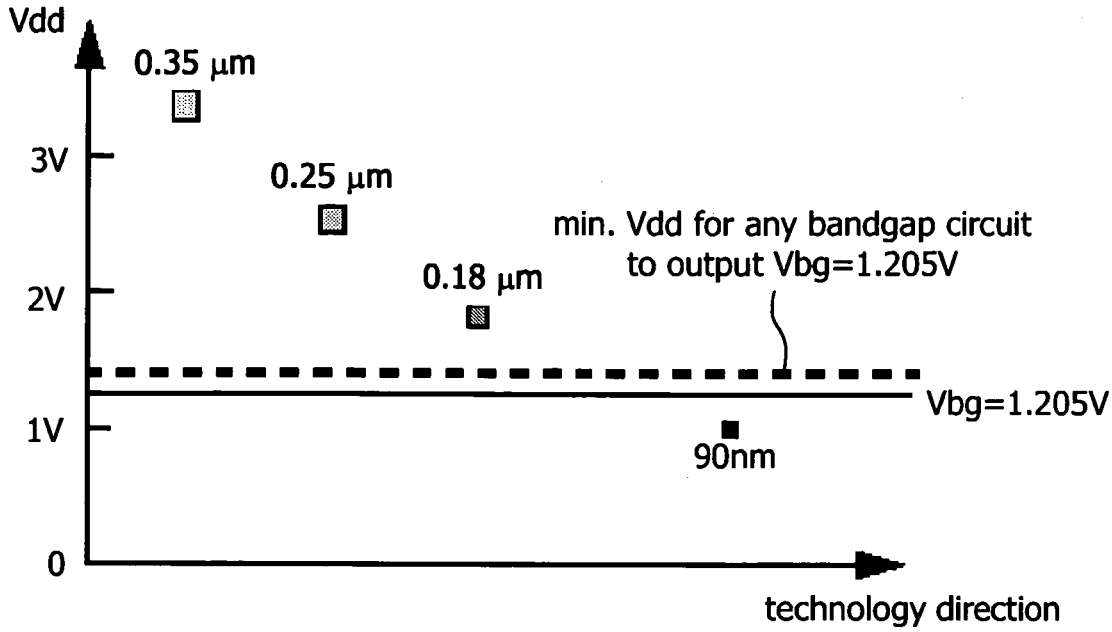
FIG. 1 shows how the supply voltage is continuously falling as the CMOS technology advances.

It is an advantage of the present invention that it is suitable for all existing and future CMOS technologies. FIG. 1 illustrates that the supply voltage Vdd drops continuously with the scaling of CMOS technology. The threshold voltage of MOS transistors, not shown in FIG. 1, also decreases with the process scaling. The Vref_new in FIG. 5 equals the gate-source voltage of transistor MN3, i.e., $$\text{Vref_new}=Vgs=V_t+\Delta V \tag{6}$$

where ΔV is the overdrive voltage, depending on the drain current Iptat, and Vt is the threshold voltage. As Iptat is usually very low, the overdrive voltage ΔV is quite small. Therefore, one can conclude that the generated reference voltage Vref_new is slightly higher than the threshold voltage at room temperature tr, so the proposed new reference voltage generator is well suited for all CMOS technologies, i.e., past, present, and future CMOS technologies. That is, CMOS scaling and the corresponding decrease in supply voltage does not have any effect on the new circuit according to the invention.

From equation (6) one can derive that the transistor MN in FIG. 4, as well as MN3 in FIG. 5A, operate in the saturation region.

In another embodiment, the proposed reference voltage generator of FIG. 5A can also be employed to generate a reference voltage higher than bandgap voltage. This can be achieved if the transistor MN3 is replaced by two or more stacked MOS transistors. By stacking at least two transistors of the same size as MN3 in FIG. 5A, for example, an output reference voltage Vref_new with a value of twice that of equation (6) can be obtained if body effects are neglected. In this case, a higher supply voltage Vdd is required. As an example, Vref_new=1.8V can be produced by replacing MN3 in FIG. 5A by two stacked transistors.

Figure 5B:
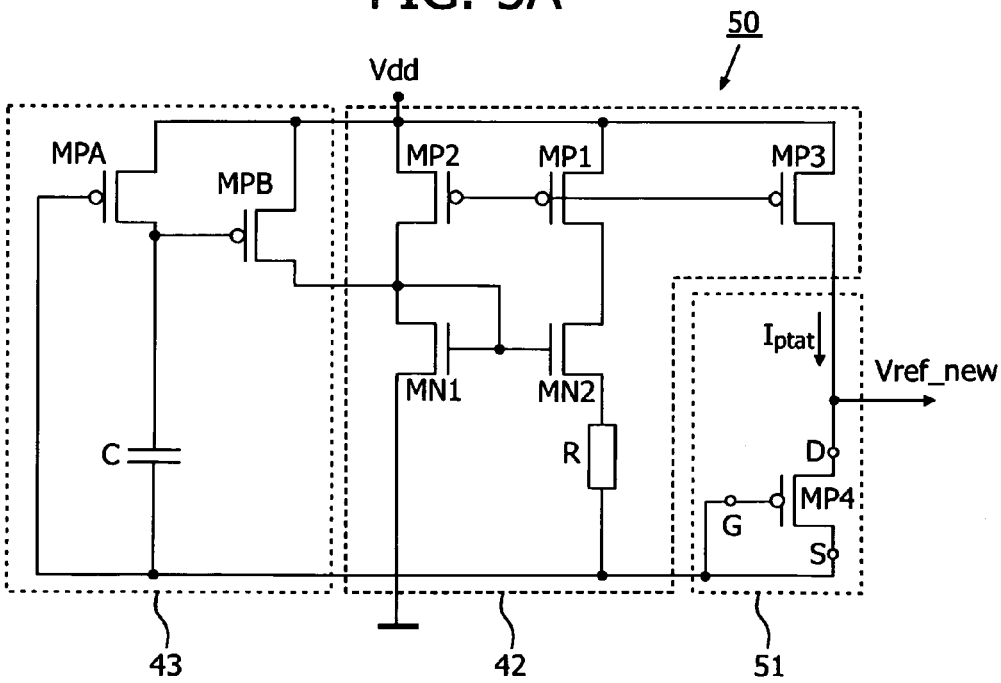
FIG. 5B shows a schematic block diagram of a third embodiment of the present invention.

It is to be mentioned that the transistor MN in FIG. 4 and the transistor MN3 in FIG. 5 can be replaced by a p-type MOS FET transistor MP4, for instance, as illustrated in FIG. 5B. The rest of the circuit 50, as illustrated in FIG. 5B, remains the same. Only the transconductor 51 has been modified. Note that the gate G of the transistor MP4 is now connected to ground.

Figure 5C:
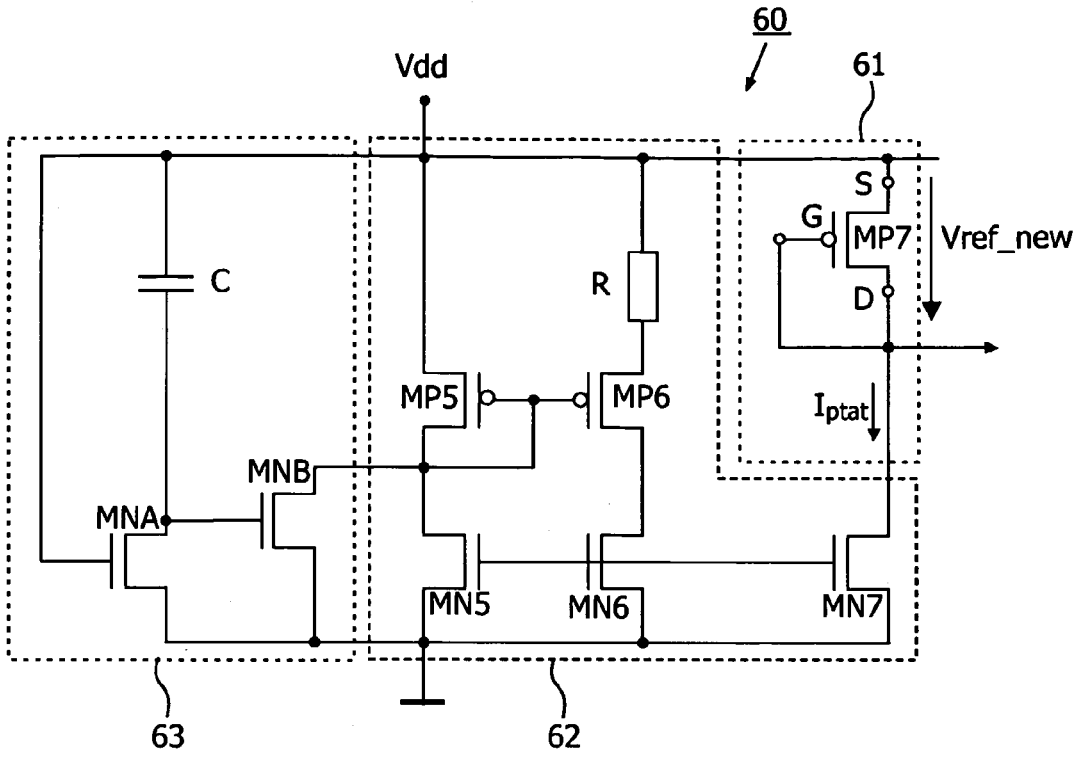
FIG. 5C shows a schematic block diagram of a fourth embodiment of the present invention.

Yet another embodiment is depicted in FIG. 5C. The embodiment 60 in FIG. 5C is based on the embodiment of FIG. 5A. The p-type transistors have been replaced by n-type transistors and vice versa. Since this embodiment 60 is basically the same as the one depicted in FIG. 5C, reference is made to the description of FIG. 5A. The transconductor 61 comprises a p-type MOS FET transistor MP7 that is situated between the supply voltage node and the output node. The start-up circuit 63 and the current generator 62 operate in the same way as the ones depicted in FIGS. 5A and 5B, with the only difference, that the transistor types have been replaced and that the output voltage refers now to the supply voltage.

The transistors MP4 and MP7 in FIGS. 5B and 5C, respectively, are operated in the saturation region.

Such an embodiment with two or even more stacked transistors serving as transconductor show an almost straight line behavior, very easy for further compensation.

Compared with the standard bandgap, the new reference voltage generator is much simpler, consumes much less power, and is easier to design.

It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable subcombination.

In the drawings and specification there has been set forth preferred embodiments of the invention and, although specific terms are used, the description thus given uses terminology in a generic and descriptive sense only and not for purposes of limitation.

The invention claimed is:

1. Reference voltage generator providing a reference voltage, the voltage generator being operated at a supply voltage being lower than the Silicon bandgap voltage, comprising a MOSFET transistor with drain, source and gate, said MOSFET transistor serving as transconductor, an input node for feeding a drain current into the drain of said MOSFET transistor, an output node being connected to the drain of said MOSFET transistor, a current generator allowing said MOSFET transistor to be operated in a specific mode where the drain current has a positive temperature coefficient and the transconductor has a negative temperature coefficient, whereby said MOSFET transistor's dimensions are chosen such that said negative temperature coefficient approximates said positive temperature coefficient such that said reference voltage, as provided at said output node, is temperature-compensated.

2. The Reference voltage generator of claim 1, wherein the MOSFET transistor provides a gate-to-source voltage between its gate and source, said gate-to-source voltage having a negative temperature coefficient.

3. The Reference voltage generator of claim 1, wherein the gate-to-source voltage between the gate and source of the MOSFET transistor is smaller than a predetermined voltage when said MOSFET transistor is operated in said specific mode.

4. The Reference voltage generator of claim 1, wherein the drain current is proportional to the absolute temperature since its temperature coefficient is positive.

5. The Reference voltage generator according to claim 1, wherein said MOSFET transistor is an n-type MOSFET transistor, and preferably an n-type CMOS transistor, the gate of said MOSFET transistor being connected to said output node.

6. The Reference voltage generator according to claim 1, wherein said MOSFET transistor is a p-type MOSFET transistor, and preferably a p-type CMOS transistor, the gate of said MOSFET transistor being connected to ground.

7. The Reference voltage generator according to claim 1, wherein said transconductor comprises two or more stacked MOSFET transistors.

* * * * *